United States Patent [19]

Wolowski et al.

[11] 4,126,431

[45] Nov. 21, 1978

[54] METHOD FOR THE PRELIMINARY TREATMENT OF CRUDE GAS FROM A THERMIC CARBON REFINEMENT PROCESS

[75] Inventors: Eckard Wolowski, Mülheim; Martin Hameier, Essen, both of Germany

[73] Assignee: Didier Engineering GmbH, Essen, Germany

[21] Appl. No.: 745,925

[22] Filed: Nov. 29, 1976

[30] Foreign Application Priority Data

Dec. 5, 1975 [DE] Fed. Rep. of Germany ..... 2554742

[51] Int. Cl.[2] ..... B01D 5/00; B01D 51/00; B01D 53/00

[52] U.S. Cl. ..... 55/23; 55/89; 55/93; 55/222; 261/128; 261/150; 261/157; 302/66

[58] Field of Search ..... 55/23, 27, 80, 83, 84, 55/89, 93, 222, 269, 68, 69, 229, 228; 302/66; 261/128, 157, 150–152; 201/29, 39

[56] References Cited

U.S. PATENT DOCUMENTS

| | | | |
|---|---|---|---|
| 1,926,058 | 9/1933 | Odell | 55/84 X |
| 2,809,717 | 10/1957 | Schmalenbach | 55/23 |
| 2,899,012 | 8/1959 | Davis | 55/69 |
| 3,619,983 | 11/1971 | Rohr | 55/89 |
| 3,976,446 | 8/1976 | Sims | 55/80 X |
| 4,036,606 | 7/1977 | Zimmermann et al. | 55/229 X |

FOREIGN PATENT DOCUMENTS

| | | | |
|---|---|---|---|
| 2,358,678 | 5/1975 | Fed. Rep. of Germany | 55/222 |
| 158,915 | 2/1921 | United Kingdom | 55/84 |
| 304,145 | 5/1930 | United Kingdom | 55/84 |
| 1,013,509 | 12/1965 | United Kingdom | 55/93 |

*Primary Examiner*—Frank W. Lutter
*Assistant Examiner*—Kathleen J. Prunner
*Attorney, Agent, or Firm*—Wenderoth, Lind & Ponack

[57] ABSTRACT

An untreated crude gas is passed through a heat emitting portion of an indirect heat exchanger and thereby cooled, and then passed to a scrubber and further cooled to a separation temperature lower than the boiling points of impurities, whereby the impurities are condensed and removed, thus forming a treated crude gas. A compressor subjects the treated crude gas to impact condensation, thus removing residual impurities. The treated crude gas is then passed through a heat absorbing portion of the heat exchanger and heated by the untreated crude gas to a temperature approximating the initial untreated crude gas inlet temperature.

7 Claims, 1 Drawing Figure

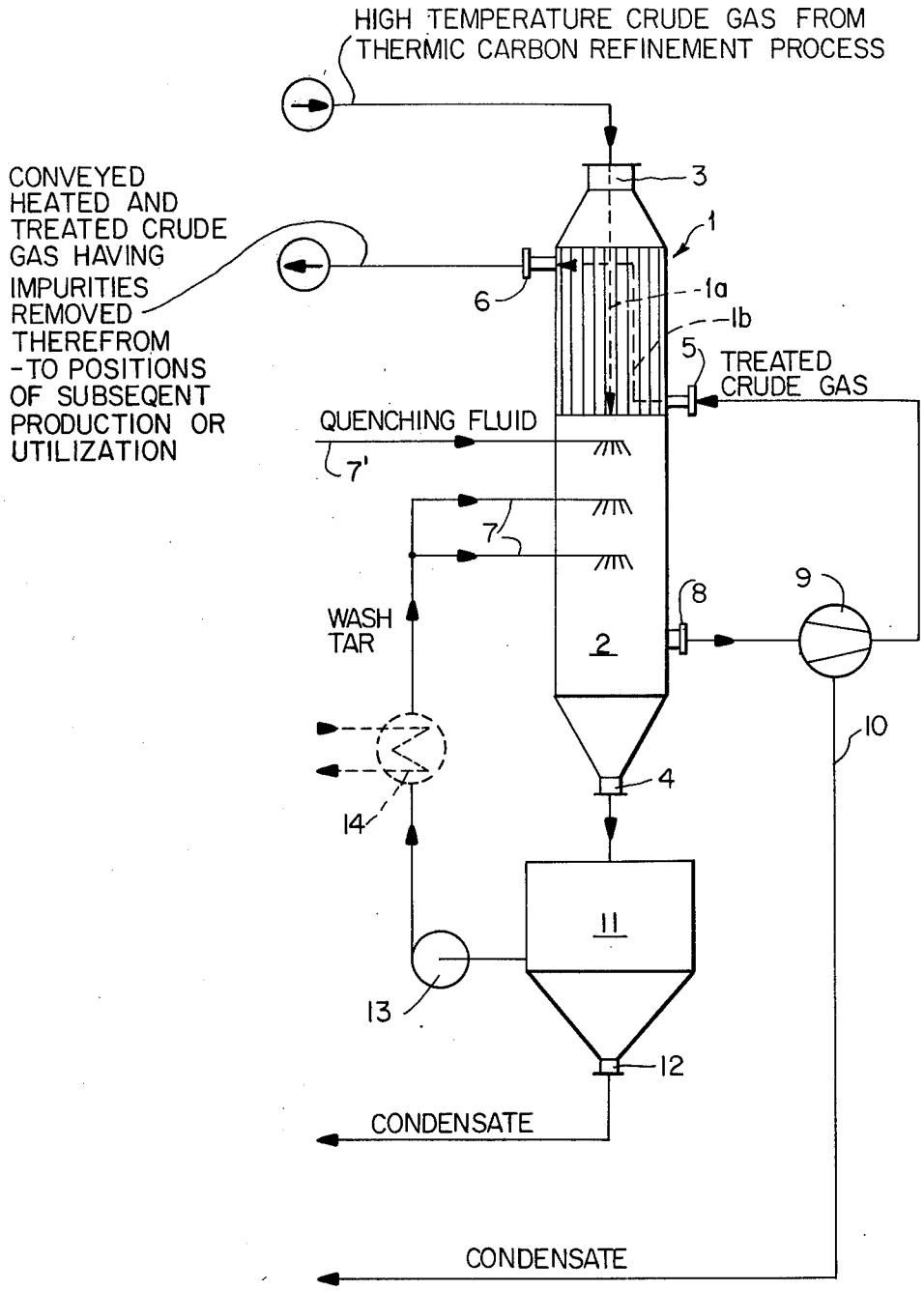
HIGH TEMPERATURE CRUDE GAS FROM THERMIC CARBON REFINEMENT PROCESS
CONVEYED HEATED AND TREATED CRUDE GAS HAVING IMPURITIES REMOVED THEREFROM -TO POSITIONS OF SUBSEQENT PRODUCTION OR UTILIZATION
3
1
1a
1b
6
5
TREATED CRUDE GAS
QUENCHING FLUID
7'
7
8
9
WASH TAR
2
10
4
14
11
13
12
CONDENSATE
CONDENSATE

METHOD FOR THE PRELIMINARY TREATMENT OF CRUDE GAS FROM A THERMIC CARBON REFINEMENT PROCESS

BACKGROUND OF THE INVENTION

The present invention relates to a process for the preliminary treatment, particularly the preliminary cleaning, of a high temperature crude gas such as that obtained by means of a thermic carbon refinement process, such as a low temperature distillation operation. Furthermore, the present invention discloses an apparatus for carrying out such process.

It is desired that the crude gas obtained in a thermic carbon refinement process by compressed and transported at high temperatures. In existing conventional processes, the crude gas is transported at a high temperature equal to the temperature at which it emerges from the preceding carbon refinement process. In the case of a low temperature distillation operation, for example, this exit temperature is 600° C. This, however, produces breakdowns which are caused by condensation and/or dust deposits in the transporting or conveying system. In existing processes it is not possible to connect an additional compressor in the crude gas offtake, since such condenser would be susceptible to breakdowns caused by the expected condensates.

SUMMARY OF THE INVENTION

The object of the present invention is to subject such crude gas to a preliminary cleaning operation so that it can pass through subsequent production stages without causing condensation deposits or cracking.

This object is achieved in accordance with the present invention by passing the untreated crude gas at a high initial temperature through an indirect heat exchanger, thereby causing the untreated crude gas to emit heat. Heat is further withdrawn from the untreated gas in a scrubber until a separation temperature is obtained at which tar, dust and other components with boiling points higher than the separation temperature are separated. The thereby precleaned crude gas is returned through the heat exchanger and absorbs heat so that its exit temperature is of approximately the same order of magnitude as the initial inlet temperature of the untreated gas. The inlet temperature for crude gas obtained by means of a low temperature distillation process is, for example, 600° C. By separating tar, dust and other components of the crude gas from the crude gas after the crude gas has been cooled and before it is thereafter heated, it is possible to thereafter convey the crude gas at a high temperature without causing the operational breakdowns common to the prior art. The indirect heat exchange operation between the untreated crude gas and the precleaned crude gas provides a simple method to lower the temperature of the crude gas so that it may be cleaned and to thereafter raise the temperature of the then precleaned crude gas to a level that is more or less the same as the initial temperature of the untreated crude gas obtained in the preceding carbon refinement process. At the same time, considerable heat losses are avoided.

Examples of crude gas to be treated in accordance with the invention are gas from a low temperature carbonization or distillation operation, coke oven gas and gas from coal gasification operations. These are, however, exemplary only, and the present invention is applicable to the treatment of any gas which is preferably conveyed at a temperature which would cause breakdowns due to condensation of impurities in the gas at such temperature.

The untreated crude gas enters the indirect heat exchanger at the temperature of the preceding process. Preferably, this temperature is from 400° to 1200° C., at a pressure of from approximately 1 to 700 bar, for the above carbon refinement processes, and most preferably is approximately 600° C.

The separation temperature, for the above carbon refinement processes, is preferably 250° to 450° C. Most preferably, this separation temperature is approximately 350° C., and the crude gas is reduced in temperature in the indirect heat exchanger to approximately 350° to 400° C.

A further advantageous feature of the present invention is that the precleaned crude gas is compressed in a compressor before being returned through the indirect heat exchanger to be heated therein by the untreated crude gas. For the operation of the compressor, it is advantageous that the crude gas be precleaned, and, in comparison with the inlet temperature of the untreated crude gas, that the compressor operates at a relatively low temperature level. By passing the precleaned crude gas through the compressor, impact condensation of the crude gas occurs, thereby removing a minor fraction of impurity condensates which were not removed in the scrubber. Further, by passing the precleaned crude gas through the compressor, the temperature of the gas is raised, thereby aiding in returning the treated crude gas to the desired raised temperature. For the above carbon refinement processes, the temperature of the cleaned crude gas is raised by the compressor to preferably 280 to 480° C.

In connection with cooling in the heat exchanger and subsequent cooling down to the separation temperature for the purpose of tar and other impurity separation, a flow of wash tar is preferably supplied to the scrubber. This flow of wash tar is preferably withdrawn from the tar separated as condensate from the scrubber. Instead of, or in addition to, the flow of wash tar, it is possible to use a flow of another quenching material to reduce the temperature of the crude gas to the separation temperature. Examples of such quenching materials are water and hydrocarbons having boiling points above the desired separation temperature.

In addition to the improved transport characteristics of the precleaned gas, there is also the added advantage that the precleaned crude gas produces, only in the most limited way, cracking symptoms on over-heated surfaces such as are encountered, for example, in heat exchangers, burners or whirling beds.

A preferred apparatus or installation for carrying out the process of the invention is distinguished in that the heat exchanger is mounted vertically over the scrubber. Preferably, the heat exchanger and the scrubber are combined into a single integrated unit.

BRIEF DESCRIPTION OF THE DRAWING

Additional refinements and features of the invention will become apparent from the following description of a preferred embodiment, taken with the accompanying drawing which is a schematic illustration of an installation for the implementation of the process of the invention.

DETAILED DESCRIPTION OF THE INVENTION

An indirect heat exchanger 1 is mounted over a scrubber 2. The heat exchanger 1 and the scrubber 2 are preferably combined into a single unit which at the top thereof is provided with an untreated crude gas inlet 3, and which is provided at the bottom thereof with an outlet 4 through which separated components and condensates can be exhausted or withdrawn. The heat emitting part 1*a* of the heat exchanger 1, through which passes the untreated crude gas, leads directly from the inlet 3 into the scrubber 2. The heat absorbing part 1*b* of the heat exchanger 1, through which passes the cleaned or treated crude gas, is composed of a casing having inlet connection 5 and outlet connection 6.

The scrubber 2 is provided, for the purpose of reducing the crude gas temperature to the desired separation temperature, with a plurality of connections 7 and 7' to supply material to quench the crude gas. In addition, the scrubber 2 is provided with a precleaned crude gas outlet 8. Between the gas outlet 8 and the inlet connection 5 is a compressor 9. The compressor 9 is provided with a condensate outlet 10.

The outlet 4 of the scrubber is connected to a storage tank 11 which ends in a condensate trap 12. In addition, the storage tank 11 is provided with a pump 13, which conveys wash tar from the storage tank 11 to the connections 7. Between pump 13 and the connections 7 is an additional indirect heat exchanger 14 which can be used, if necessary, to lower the temperature of the wash tar. The drawing illustrates two connections 7 for the supply of wash tar from tank 11 and one connection 7' for the supply of a supplemental or alternative quenching material. It is to be understood, however, that a smaller or larger number of connections may be used, as necessary.

The process of the invention will now be described in more detail, with specific reference to the cleaning treatment of a crude gas from a thermic carbon refinement process of the low temperature distillation type. It will be understood that the specific temperatures and pressures will vary from one treatment to another, depending on the initial untreated crude gas temperature, the desired crude gas transportation temperature, and the composition of the crude gas and the impurities therein.

Untreated high temperature crude gas at a temperature of 600° C. and a given pressure, determined by the thermic carbon refinement process, is passed into the heat emitting portion of the heat exchanger 1 by way of the crude gas inlet 3. The gas is cooled in the heat exchanger to a temperature of approximately 350° to 400° C. to form preliminarily cooled crude gas and then passes into scrubber 2. By means of wash tar passed by pump 13 from tank 11 through connections 7, the preliminarily cooled crude gas is further cooled in a direct current to a separation temperature of 350° C. to form further cooled crude gas. In the event that the temperature of the crude gas is not sufficiently cooled by the wash tar to 350° C., then the wash tar may be cooled by the heat exchanger 14, or a supplemental or alternative current of quenching material is introduced via connection 7'. At the separation temperature, tar, dust particles and other impurities with boiling points above 350° C. are condensed and separated from the further cooled crude gas to form treated crude gas and are conveyed via outlet 4 to the collector tank 11. By way of the condensate trap 12, the separated condensates and components are branched off for further production.

The cleaned and treated crude gas passes through the gas outlet 8 to the compressor 9 whereat the pressure of the gas is raised to a desired level. Inside the compressor there occurs the separation of a minor residual fraction of impurities or components with boiling points higher than 350° C., by way of impact condensation. The condensate that is thus obtained is removed by way of the condensate outlet 10.

When the treated crude gas is compressed by compressor 9, the crude gas temperature is correspondingly raised, e.g. to 380° C. The compressed treated crude gas is then returned to the heat exchanger 1 and passed through the heat absorbing portion of the heat exchanger 1 via inlet connection 5. The crude gas is heated, by heat exchange with the untreated crude gas, and leaves the heat exchanger 1 at a temperature that is in the neighborhood of or approximating the entry temperature of 600° C. of the untreated high temperature crude gas.

It will be understood that modifications and variations may be made to the above specifically described operations and structures without departing from the scope of the invention.

What is claimed is:

1. In a process of conveying high temperature crude gas derived from a thermic carbon refinement process to positions of subsequent production or utilization, said high temperature crude gas containing condensable components including impurities having boiling points higher than 350° C., such impurities being capable, during conveyance of said high temperature crude gas, of condensation, thereby forming condensates which interfere with the conveyance of said high temperature crude gas, the improvement comprising removing from said high temperature crude gas only said impurities which have boiling points above 350° C. and which are capable of forming condensates during the conveyance of said high temperature crude gas, while avoiding the removal of the remainder of said condensable components and while substantially maintaining the high temperature of said high temperature crude gas during substantially the entire length of the conveyance thereof to said positions of subsequent production or utilization, said operation of removing comprising:

passing said high temperature crude gas containing therein said impurities, derived from said thermic carbon refinement process, at the exit temperature from said process, through a heat emitting portion of an indirect heat exchanger, and thereby preliminarily cooling said high temperature crude gas to form preliminarily cooled crude gas;

passing said preliminarily cooled crude gas from said heat exchanger through a scrubber and therein further cooling said preliminarily cooled crude gas by contact with a cooling liquid to a separation temperature of approximately 350° C., which is lower than said boiling points of said impurities, thereby forming further cooled crude gas and condensing said impurities from said further cooled crude gas to form treated crude gas;

collecting the thus condensed impurities and passing said collected impurities into and through said scrubber in the form of a flow of wash tar which is used as said cooling liquid to perform said step of further cooling said preliminarily cooled crude gas; and passing said treated crude gas from said scrubber through a heat absorbing portion of said indirect heat exchanger, and thereby heating said treated crude gas, by heat exchange with said high temperature crude gas in said heat emitting portion of said indirect heat exchanger, to a temperature approximately equal to said exit temperature from said thermic carbon refinement process, whereby said treated crude gas may thereafter be conveyed to said positions of subsequent production or utilization without the formation of condensates.

2. The improvement claimed in claim 1, further comprising cooling said wash tar before passage thereof into said scrubber.

3. The improvement claimed in claim 1, further comprising passing a flow of supplemental quenching material into said scrubber to aid in said step of further cooling said preliminarily cooled crude gas.

4. The improvement claimed in claim 1, wherein said high temperature crude gas is at an exit temperature of from 400° to 1200° C. when introduced into said heat exchanger.

5. The improvement claimed in claim 4, wherein said high temperature crude gas is at an exit temperature of approximately 600° C. when introduced into said heat exchanger.

6. The improvement claimed in claim 1, further comprising passing said treated crude gas from said scrubber, before passage to said heat exchanger, through a compressor and therein subjecting said treated crude gas to impact condensation, thereby removing residual impurities not removed in said scrubber, and preliminarily heating said treated crude gas.

7. The improvement claimed in claim 6, wherein said treated crude gas is heated to a temperature of approximately 380° C. by passage through said compressor.

* * * * *